US008144899B2

(12) United States Patent
Song et al.

(10) Patent No.: US 8,144,899 B2
(45) Date of Patent: Mar. 27, 2012

(54) ACOUSTIC TRANSDUCER AND MICROPHONE USING THE SAME

(75) Inventors: Po-Hsun Song, Tainan (TW); Jen-Yi Chen, Sinpu Township (TW); Kai-Hsiang Yen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 909 days.

(21) Appl. No.: 12/184,191

(22) Filed: Jul. 31, 2008

(65) Prior Publication Data

US 2009/0086999 A1 Apr. 2, 2009

Related U.S. Application Data

(60) Provisional application No. 60/976,743, filed on Oct. 1, 2007.

(51) Int. Cl.
*H04R 25/00* (2006.01)
*H04R 11/02* (2006.01)

(52) U.S. Cl. ..... 381/184; 381/423

(58) Field of Classification Search ..... 438/53; 257/416; 381/184, 423
See application file for complete search history.

(56) References Cited

U.S. PATENT DOCUMENTS

| | | | | |
|---|---|---|---|---|
| 6,788,769 | B1 | 9/2004 | Waites | |
| 6,936,524 | B2 | 8/2005 | Zhu et al. | |
| 7,239,712 | B1 | 7/2007 | Drury et al. | |
| 7,346,178 | B2 * | 3/2008 | Zhe et al. | 381/174 |
| 7,400,737 | B2 * | 7/2008 | Pedersen | 381/175 |
| 2006/0093170 | A1 | 5/2006 | Zhe et al. | |
| 2007/0058825 | A1 * | 3/2007 | Suzuki et al. | 381/174 |
| 2007/0201709 | A1 * | 8/2007 | Suzuki et al. | 381/174 |

* cited by examiner

*Primary Examiner* — Calvin Lee
(74) *Attorney, Agent, or Firm* — Finnegan, Henderson, Farabow, Garrett & Dunner, LLP

(57) ABSTRACT

An acoustic transducer comprises a substrate, a membrane configured to move relative to the substrate, a number of supports configured to suspend the membrane over the substrate, a first group of projections extending from the membrane, and a second group of projections extending from the substrate, the second group of projections being interweaved with and movable relative to the first group of projections, wherein each projection of one group of the first group of projections and the second group of projections is composed of a first conductive layer, a second conductive layer and a dielectric layer between the first conductive layer and the second conductive layer, and each projection of the other one group of the first group of projections and the second group of projections is composed of a third conductive layer.

20 Claims, 12 Drawing Sheets

ACOUSTIC TRANSDUCER AND MICROPHONE USING THE SAME

CROSS-REFERENCE TO RELATED APPLICATIONS

This application claims the benefit of U.S. Provisional Application No. 60/976,743, filed Oct. 1, 2007 which is incorporated herein by reference.

BACKGROUND OF THE INVENTION

The present invention generally relates to an acoustic transducer and, more particularly, to a microphone using the acoustic transducer.

Silicon-based condensers, which may be capable of converting acoustic energy to electrical energy, are also known as acoustic transducers. In some conventional acoustic transducer may include a perforated backplate and a membrane being susceptible to acoustic waves. For example, in microphones, a dielectric medium, such as air, may commonly exist between the backplate and the membrane so as to form a capacitor structure. Nevertheless, in certain aspects, the characteristics of a capacitor may largely depend on the spacing or distance between the backplate and the membrane. For example, the backplate and the membrane may need to be carefully arranged to avoid electrical contact that may result in short-circuiting. Accordingly, an extra isolation structure may even be used to prevent short-circuiting. A design that introduces one more backplate into an acoustic transducer may sense two differential potentials between each backplate and the membrane during vibration of the membrane. However, such an extra isolation structure or backplate may complicate the fabrication of acoustic transducers as well as raise the cost of production.

A conventional microphone may include at least one transducer and a housing covering the at least one transducer. Generally, the sensitivity of a microphone subject to acoustic waves may be determined by the supporting structure of the membrane, mechanical properties of the membrane and package type of the housing. For example, two inlets may be formed on a top surface of the housing of a conventional directional microphone, wherein the portion enclosing one of the inlets may include a damping material to delay an incident acoustic wave, thereby increasing sensitivity to acoustic waves from certain directions. Nonetheless, the process of fabricating a housing with different materials in such a design may be relatively complicated.

In another design, a conventional directional microphone array may include more than two omni-directional microphones to collect acoustic waves in all the directions from an acoustic source. However, the spatial characteristics of omni-microphones may limit downsizing of the directional microphone. For example, one of the spatial characteristics may require that omni-microphones in an array be designed with a spacing of $2\times\lambda/\pi$, which may be equivalent to approximately $0.64\lambda$. Given an incident acoustic wave having a frequency of 20 Kilo Hertz (KHz), the spacing or distance between any two microphones in the array may be greater than 1 centimeter (cm), which may be oversized in view of the increasingly compact electronic products. Moreover, different sensitivities of the microphones in the array may result in inaccuracy during transduction.

BRIEF SUMMARY OF THE INVENTION

Examples of the present invention may provide an acoustic transducer comprising a substrate, a membrane configured to move relative to the substrate, a number of supports configured to suspend the membrane over the substrate, a first group of projections extending from the membrane, and a second group of projections extending from the substrate, the second group of projections being interweaved with and movable relative to the first group of projections, wherein each projection of one group of the first group of projections and the second group of projections is composed of a first conductive layer, a second conductive layer and a dielectric layer between the first conductive layer and the second conductive layer, and each projection of the other one group of the first group of projections and the second group of projections is composed of a third conductive layer.

Some examples of the present invention may also provide an acoustic transducer comprising a substrate, a membrane configured to be movable relative to the substrate, the membrane including a conductive plane, a number of supports on the conductive plane, the supports being configured to allow the membrane to pivot relative to the substrate, a number of first projections on the conductive plane of the membrane, each of the first projections including a number of conductive layers separated from each other by at least one dielectric layer, and a number of second projections over the substrate, the second projections being interweaved with and movable relative to the number of first projections, each of the second projections including a number of conductive layers separated from each other by at least one dielectric layer.

Examples of the present invention may further provide an acoustic transducer comprising a substrate, a membrane configured to move relative to the substrate, a number of supports configured to allow the membrane to vibrate relative to the substrate, wherein at least one of the supports extends in a first direction, a first group of projections extending from the membrane in a second direction, the second direction and the first direction being transverse to one another, and a second group of projections extending from the substrate in the second direction, the second group of projections being interweaved with and movable relative to the first group of projections.

BRIEF DESCRIPTION OF THE DRAWINGS

The foregoing summary as well as the following detailed description of various embodiments of the present invention will be better understood when read in conjunction with the appended drawings. For the purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions.

Figure 1:
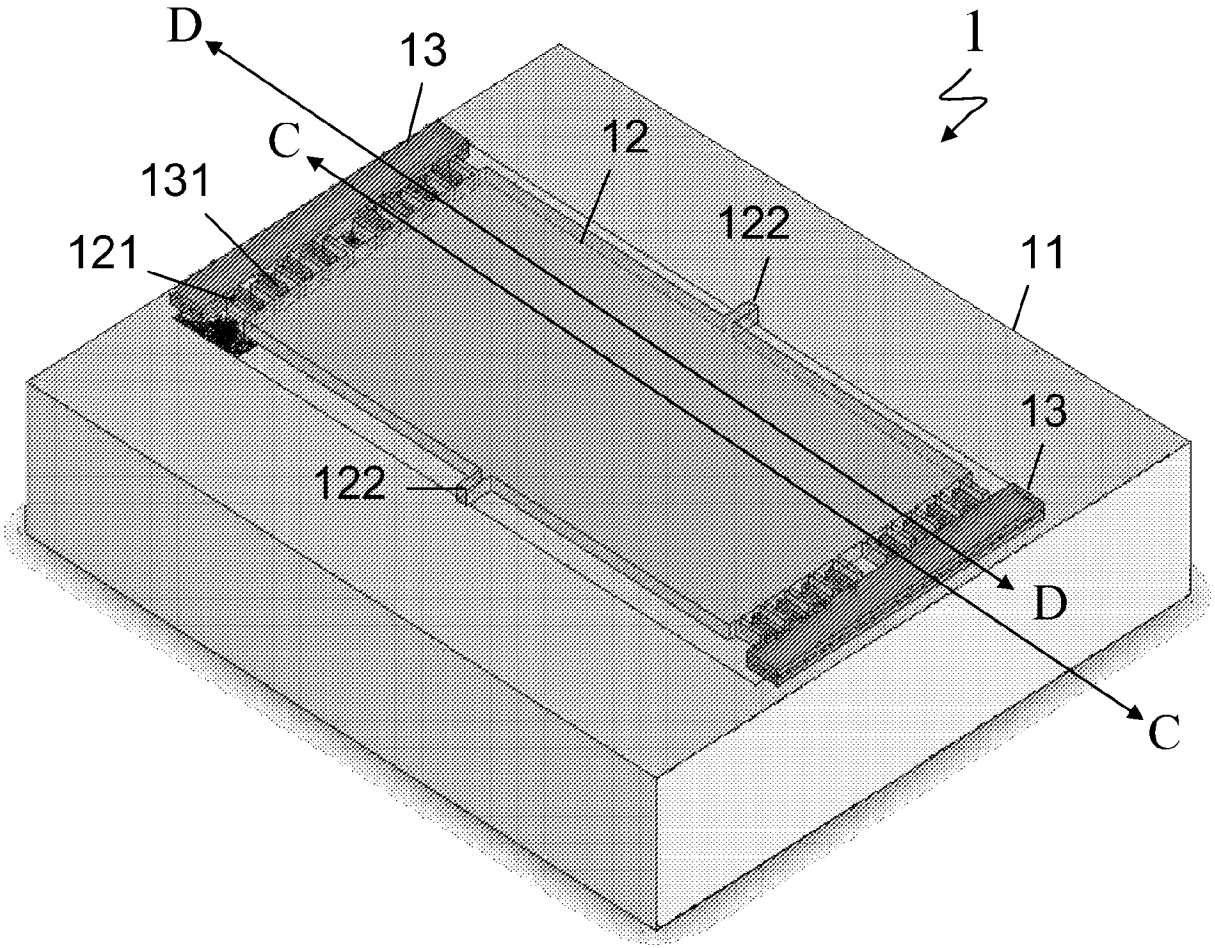
FIG. 1 is a perspective view of an acoustic transducer in accordance with an example of the present invention.

FIG. 1 is a perspective view of an acoustic transducer 1 in accordance with an example of the present invention. Referring to FIG. 1, the acoustic transducer 1 may include a substrate 11 and a membrane 12. In one example, the substrate 11 may include a silicon substrate. The substrate 11 and the membrane 12 may be formed by a Micro-Electro-Mechanical Systems (MEMS) manufacturing process, a Complementary Metal-Oxide-Semiconductor (CMOS) manufacturing process or other suitable processes.

Figure 2A:
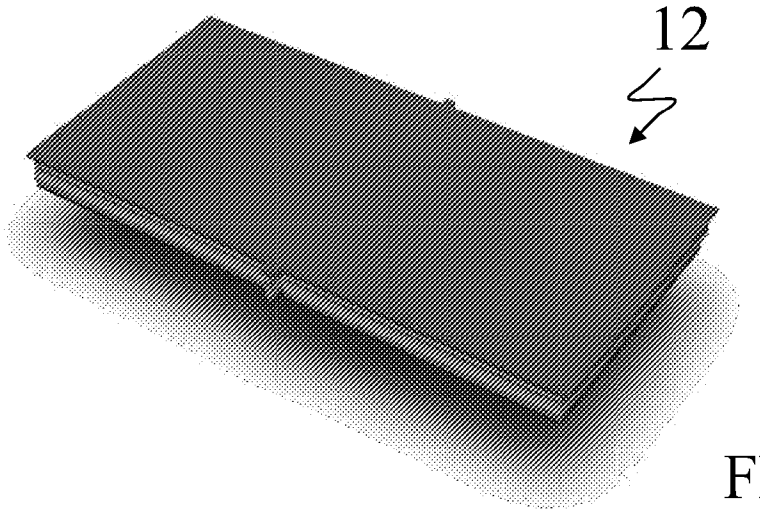
FIGS. 2A and 2B are respectively a top perspective view and a bottom perspective view of a membrane in accordance with examples of the present invention.
Figure 2B:
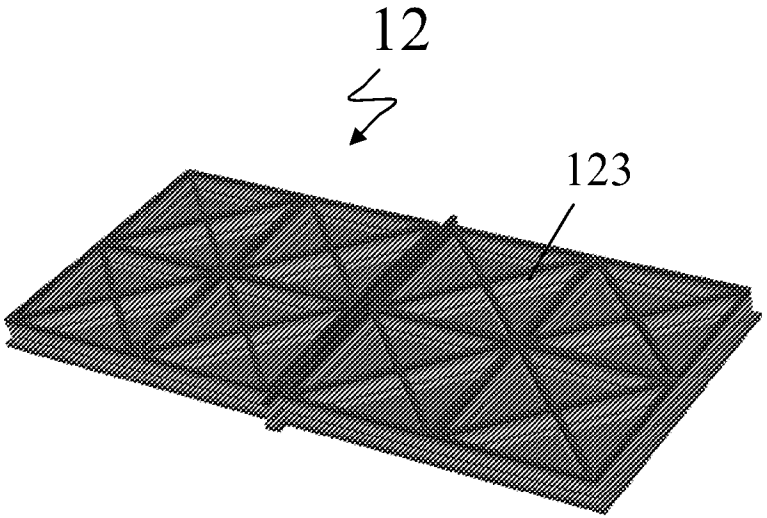

FIGS. 2A and 2B are respectively a top perspective view and a bottom perspective view of the membrane 12 illustrated in FIG. 1. Referring to FIG. 2A, the membrane 12 may include a monolayer or a multilayer structure formed by the MEMS manufacturing process, CMOS manufacturing process or other suitable processes. For simplicity, the membrane 12 illustrated in FIG. 2A only shows a multilayer structure having a stack of thin layers. Referring to FIG. 2B, the membrane 12 may include a number of ribs 123 extending in lower layers of the multilayer structure. The ribs 123 may help support or strengthen the membrane 12 and/or support the other layers of the membrane 12.

Referring back to FIG. 1, the membrane 12 may have but is not limited to a rectangular shape and may include a pair of supports 122 for supporting the membrane 12 over the substrate 11. In one example, the pair of supports 122 may extend in a widthwise direction through or near the center of gravity of the membrane 12 so that the membrane 12 may pivot with respect to the substrate 11. The pair of supports 122 may have a cubic shape, a cylindrical shape or other appropriate shapes to allow pivotable movement of the membrane 12. In another example, the substrate 11 may include recesses for accommodating the supports 122.

The membrane 12 may further include a number of projections 121 extending in a lengthwise direction. Furthermore, a patterned structure 13 over the substrate 11 may include a number of projections 131 interweaved with the number of projections 121. The structures of the projections 131 and 121 will be further described in paragraphs below.

Figure 3A:
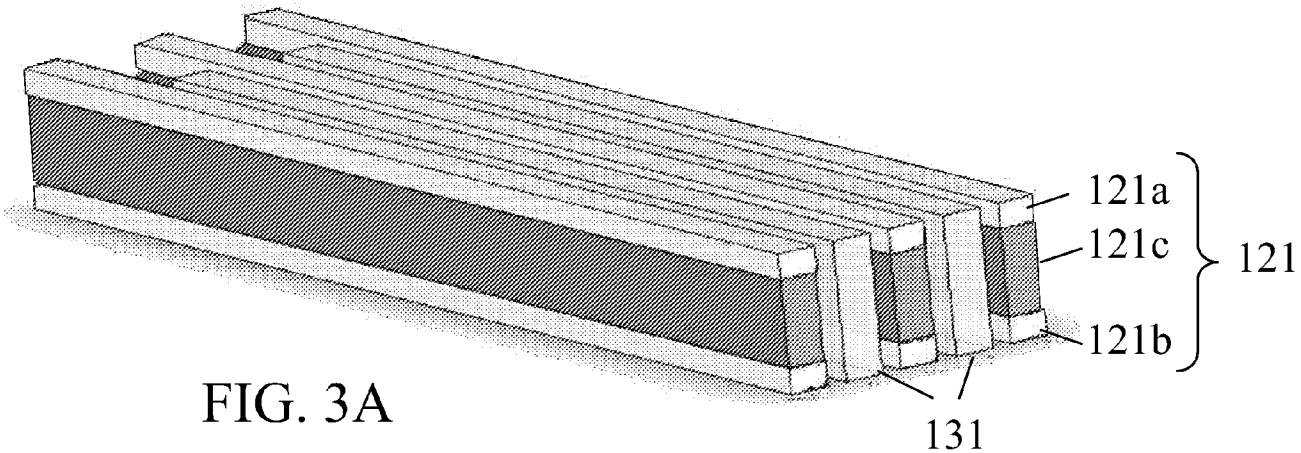
FIGS. 3A and 3B are schematic diagrams illustrating projections in accordance with examples of the present invention.
Figure 3B:
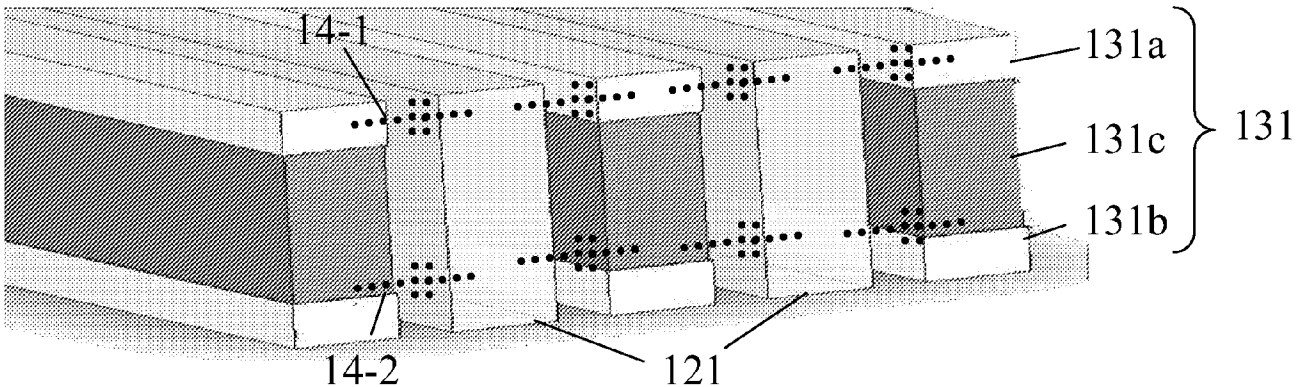

FIGS. 3A and 3B are schematic diagrams illustrating the projections 121 of the membrane 12 and the patterned layer 13 described and illustrated with reference to FIG. 1. Referring to FIG. 3A, each of the projections 131 and 121 may be interweaved with one another. The projections 121 may include an upper or first conductive layer 121*a*, a dielectric layer 121*c* and a lower or second conductive layer 121*b*. Each of the projections 131 and the conductive layers 121*a* and 121*b* may include metal, carbon, graphite and other conductive materials. The dielectric layer 121*c* may include oxide or other insulating materials.

Referring to FIG. 3B, in another example, each of the projections 131 may include a first conductive layer 131*a*, a second conductive layer 131*b* and a dielectric layer 131*c* between the first and second conductive layers 131*a* and 131*b*. Furthermore, each of the projections 121 and the conductive layers 131*a* and 131*b* may include but is not limited to a metal, carbon or graphite layer or a combination thereof. Furthermore, the dielectric layer 131*c* may include but is not limited to an oxide layer. In the present example, first capacitors 14-1, shown in dotted lines, may exist between the first conductive layers 131*a* and the projections 121, while second capacitors 14-2, shown in dotted lines, may exist between the conductive layers 131*b* and the projections 121.

Figure 4A:
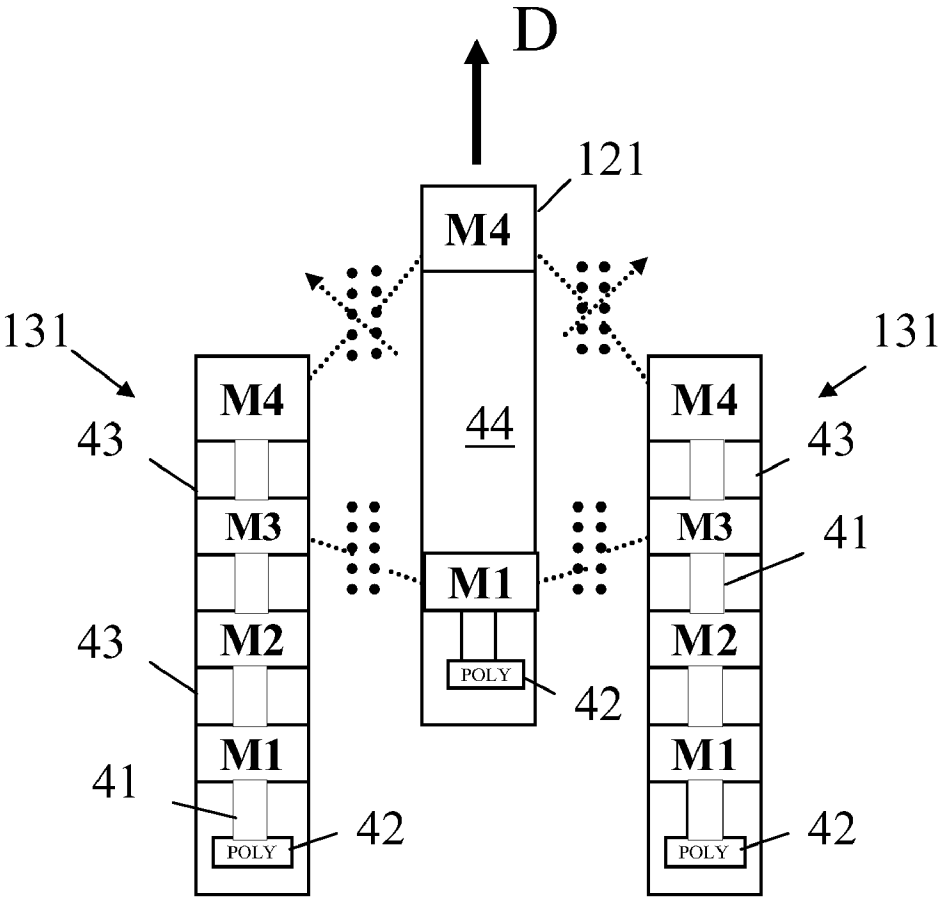
FIG. 4A is a schematic diagram illustrating the operation of projections in accordance with an example of the present invention.

FIG. 4A is a schematic diagram illustrating the operation of the projections 131 and 121 described and illustrated with reference to FIG. 1 in accordance with an example of the present invention. Referring to FIG. 4A, each of the projections 131 may include a number of conductive layers, for example, M1, M2, M3 and M4 and a conductive poly layer 42. The conductive layers M1, M2, M3 and M4 and the poly layer 42 may be separated from each other by dielectric layers 43 and electrically connected by conductive vias 41. Each of the projections 121 may include an upper conductive layer and a lower conductive layer separated by a dielectric layer 44. The upper and lower conductive layers of each of the projections 121 may be formed simultaneously with the M4 and M1 layers of the projections 131, respectively, and thus are labeled "M4" and "M1", respectively. In operation, when an acoustic wave is incident upon the membrane 12, resulting in displacement and rotation of the membrane 12 in a direction "D" relative to the projections 131, the capacitance between the upper conductive layer M4 of the projection 121 and the projection 131 may vary in response to the relative displacement of the projection 121. Furthermore, the capacitance change due to the vibrating membrane 12 may be transmitted to a processing circuit (not shown) on the substrate 11 via the supports 122.

Figure 4B:
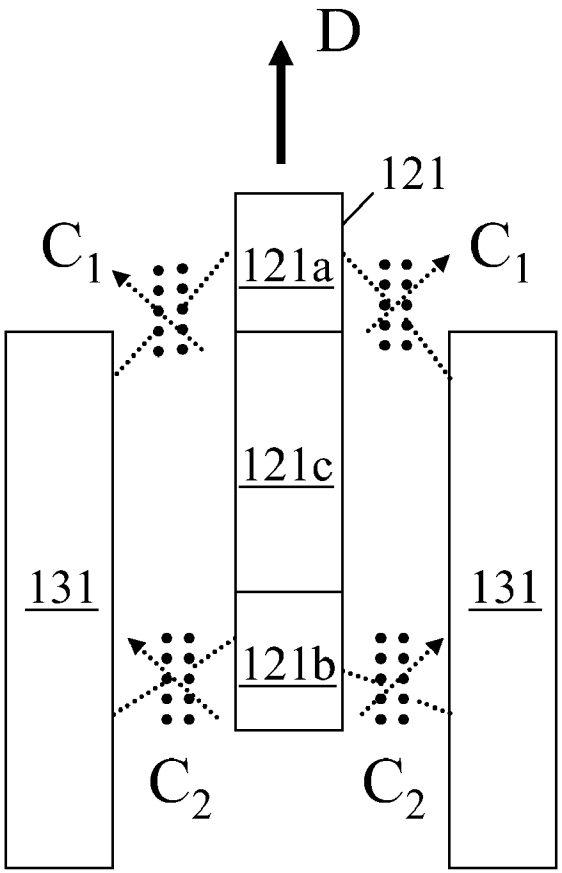
FIG. 4B is a schematic diagram illustrating the operation of projections in accordance with another example of the present invention.

FIG. 4B is a schematic diagram illustrating the operation of projections 131 and 121 described and illustrated with reference to FIG. 3A. Referring to FIG. 4B, relative movement between the projections 121 and 131 may cause change in capacitance. Specifically, the relative movement between the first conductive layer 121*a* of one projection 121 and the projections 131 may cause change in capacitance $C_1$, while the relative movement between the second conductive layer 121*b* of the projection 121 and the projections 131 may cause change in capacitance $C_2$.

Figure 5A:
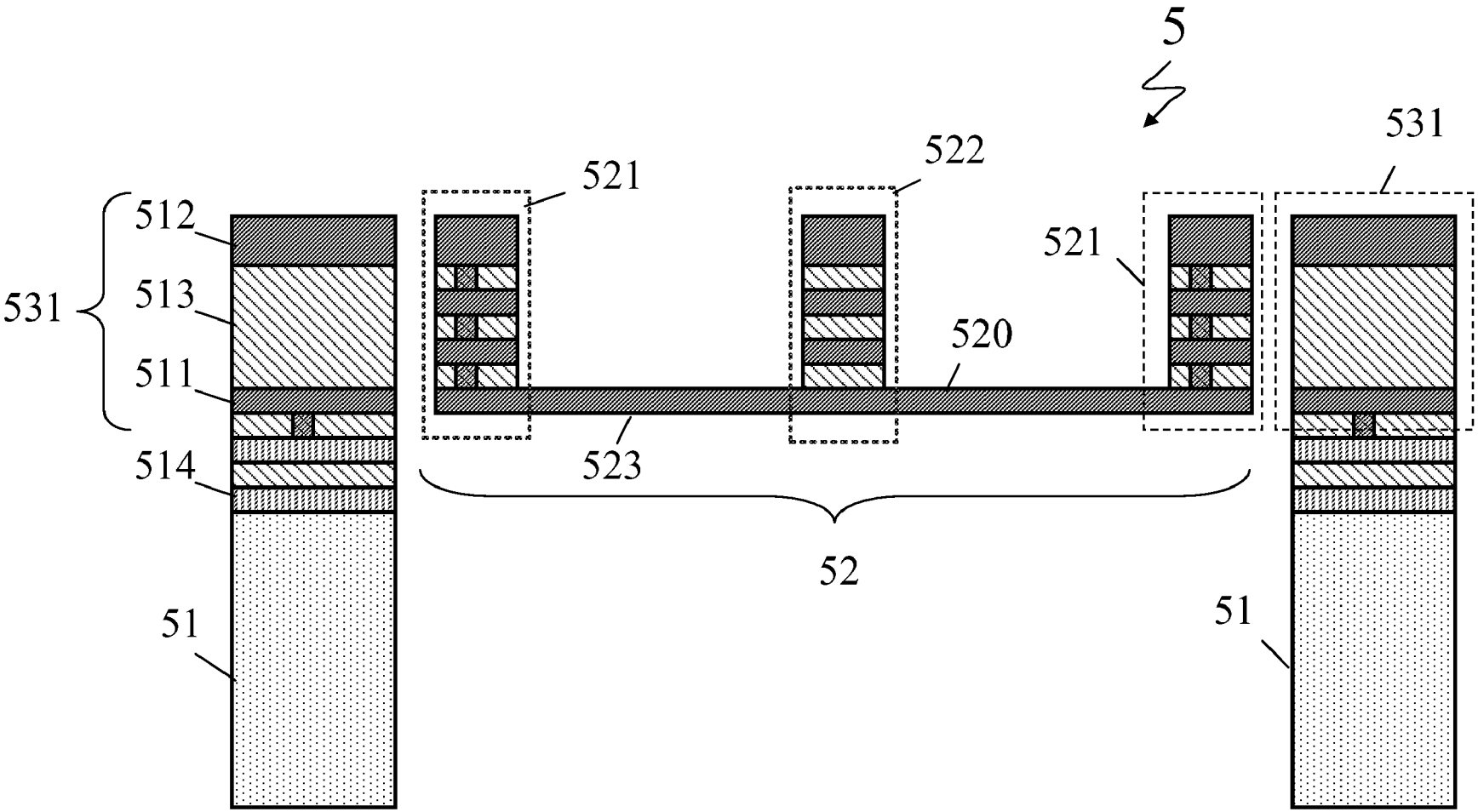
FIG. 5A is a cross-sectional view of an acoustic transducer in accordance with another example of the present invention.

FIG. 5A is a cross-sectional view of an acoustic transducer 5 in accordance with another example of the present invention. Referring to FIG. 5A, the acoustic transducer 5 may include a substrate 51 and a membrane 52. A number of projections 531, which may be taken from a line similar to the line "CC" illustrated in FIG. 1, may be formed on the substrate 51. Each of the projections 531 may include an upper conductive layer 512, a lower conductive layer 511 and a dielectric layer 513 between the upper and lower conductive layers 512 and 511. Furthermore, at least one conductive or polycrystalline layer 541 may be formed between the substrate 51 and the projections 531. The membrane 52, which may be taken from a line similar to the line "DD" illustrated in FIG. 1, may include a conductive plane 523 and projections 521 and supports 522 on a surface 520 of the conductive plane 523 facing away from the substrate 51. In one example, each of the projections 521 may include a number of conductive layers (not numbered) separated from each other by a dielectric layer (not numbered). Furthermore, each of the supports 522 may include a number of conductive layers (not numbered) separated from each other by a dielectric layer (not numbered). Moreover, the conductive plane 523 may be fabricated simultaneously with the lower conductive layer 511 and thus may be substantially coplanar with the lower conductive layer 511.

Figure 5B:
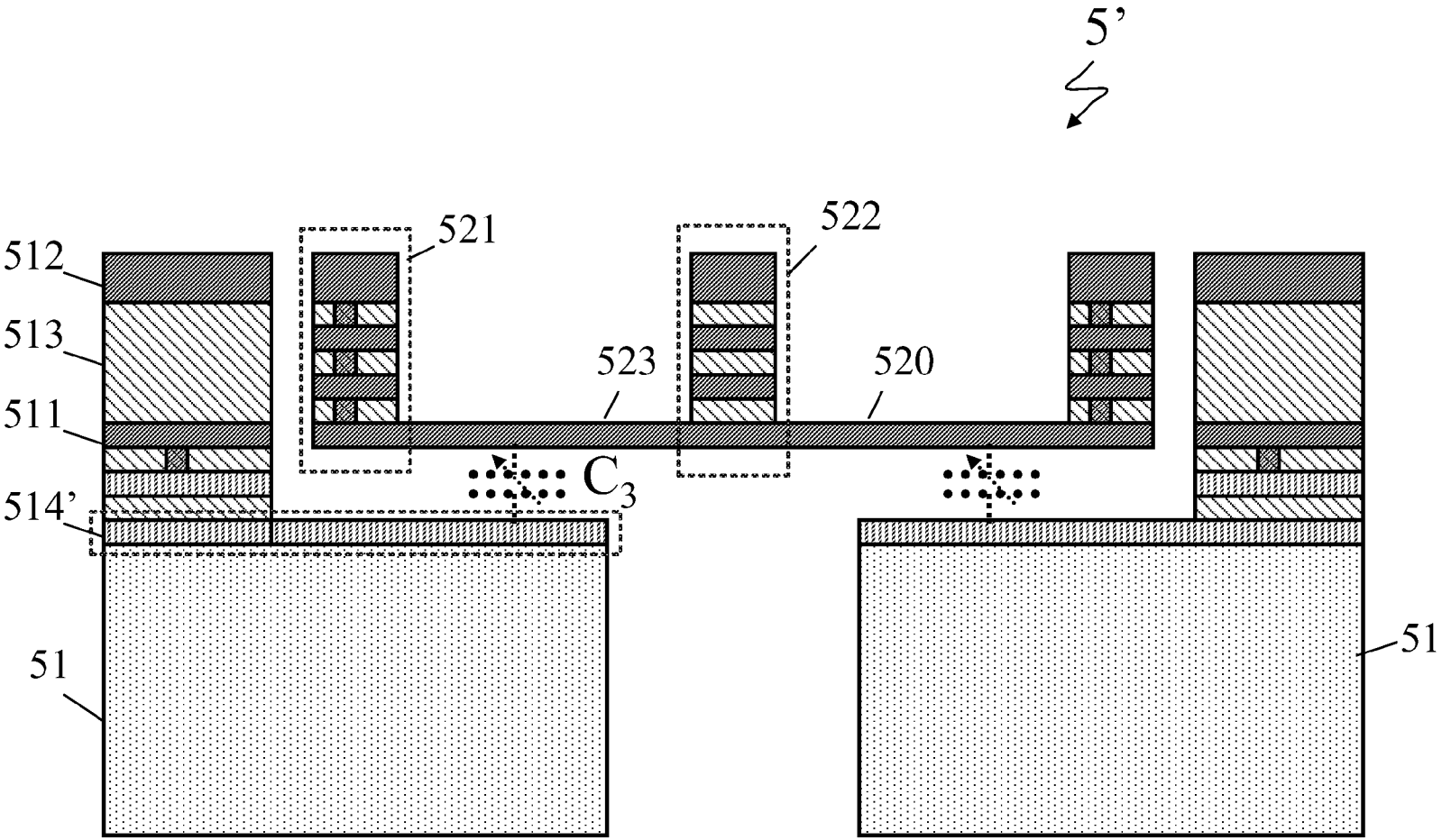
FIG. 5B is a cross-sectional view of an acoustic transducer in accordance with yet another example of the present invention.

FIG. 5B is a cross-sectional view of an acoustic transducer 5' in accordance with yet another example of the present invention. Referring to FIG. 5B, the acoustic transducer 5' may be similar in structure to the acoustic transducer 5 described and illustrated with reference to FIG. 5A except that a conductive or polycrystalline layer 514' over the substrate 51 may extend below the membrane 52. The capacitance of a capacitor $C_3$ defined between the conductive layer 514' and the membrane 52 may vary as the membrane 52 pivot with respect to the substrate 51.

Figure 6:
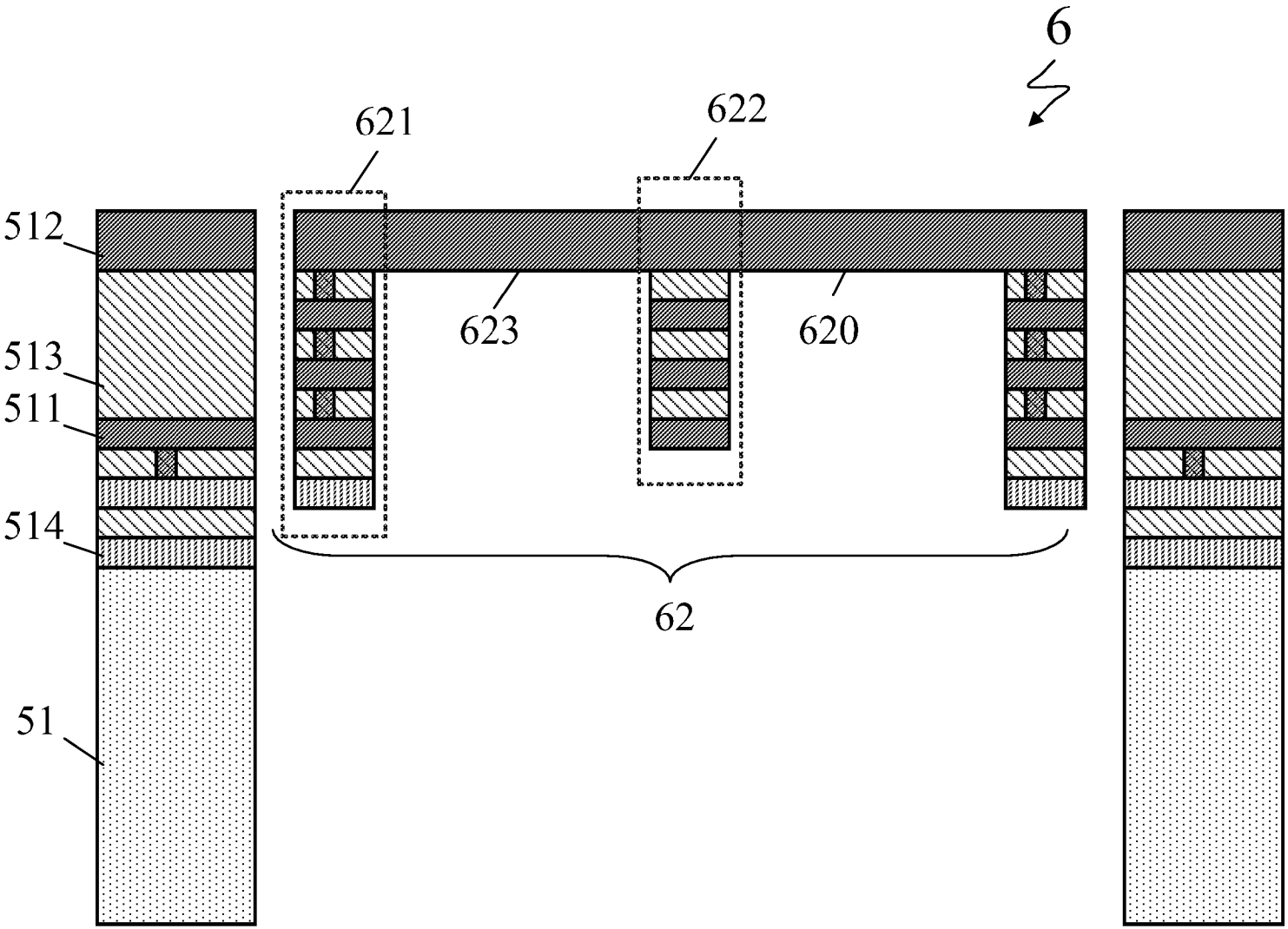
FIG. 6 is a cross-sectional view of an acoustic transducer in accordance with still another example of the present invention.

FIG. 6 is a cross-sectional view of an acoustic transducer 6 in accordance with still another example of the present invention. Referring to FIG. 6, the acoustic transducer 6 may be similar in structure to the acoustic transducer 5 described and illustrated with reference to FIG. 5A except that a membrane 62 replaces the membrane 52. The membrane 62 may include a conductive plane 623 and projections 621 and supports 622 on a surface 620 of the conductive plane 623 facing toward the substrate 51. Moreover, the conductive plane 623 may be fabricated simultaneously with the upper conductive layer 512 and thus may be substantially coplanar with the upper conductive layer 512.

Figure 7A:
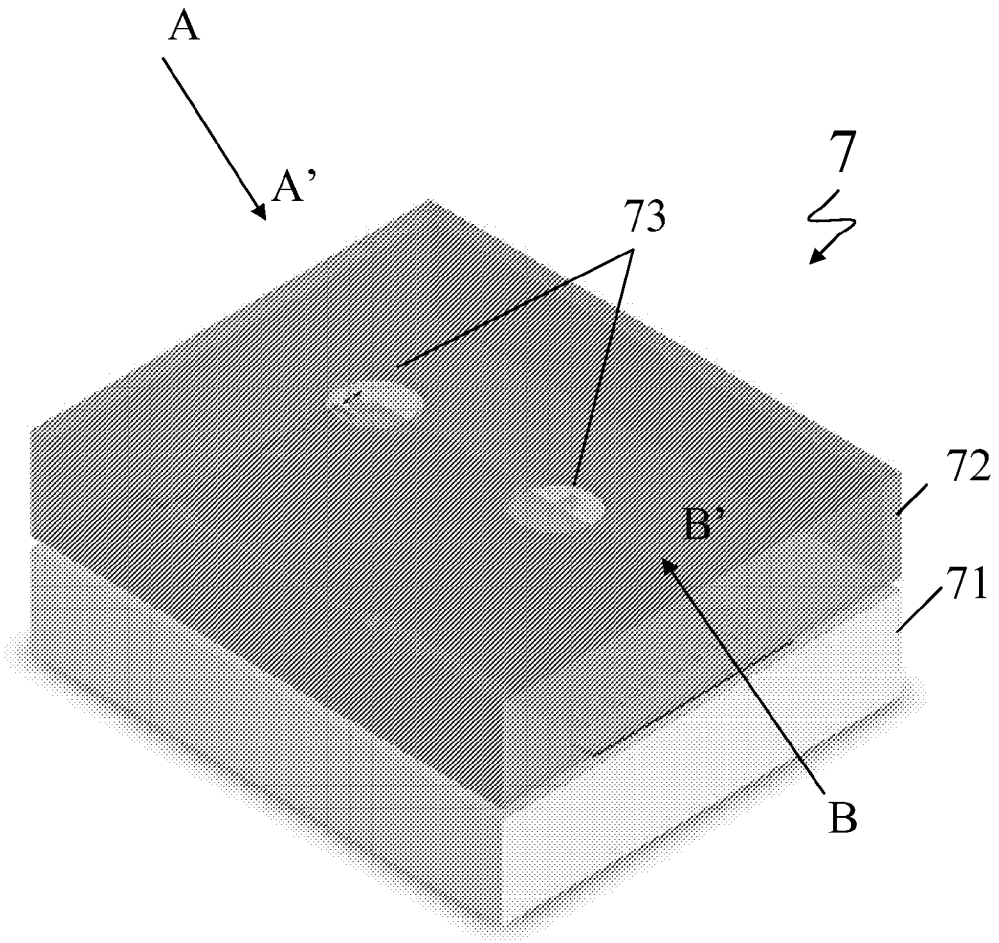
FIG. 7A is a perspective view of a microphone in accordance with an example of the present invention.

FIG. 7A is a perspective view of a microphone 7 in accordance with an example of the present invention. Referring to FIG. 7A, the microphone 7 may include an acoustic transducer 71 and a housing 72 covering the acoustic transducer 71. The acoustic transducer 71 may be similar to one of the acoustic transducers 1, 5, 5' and 6 described and illustrated with reference to FIGS. 1, 5A, 5B and 6, respectively. At least one inlet 73 may be formed on a top surface of the housing 72 for conducting acoustic waves into the microphone 7. In the present example, two inlets 73 may be formed on the top surface of the housing 72 such that the microphone 7 may be more sensitive to acoustic waves from, for example, directions AA' and BB' as indicated by arrows. Accordingly, the microphone 7 may function to serve as a directional microphone.

Figure 7B:
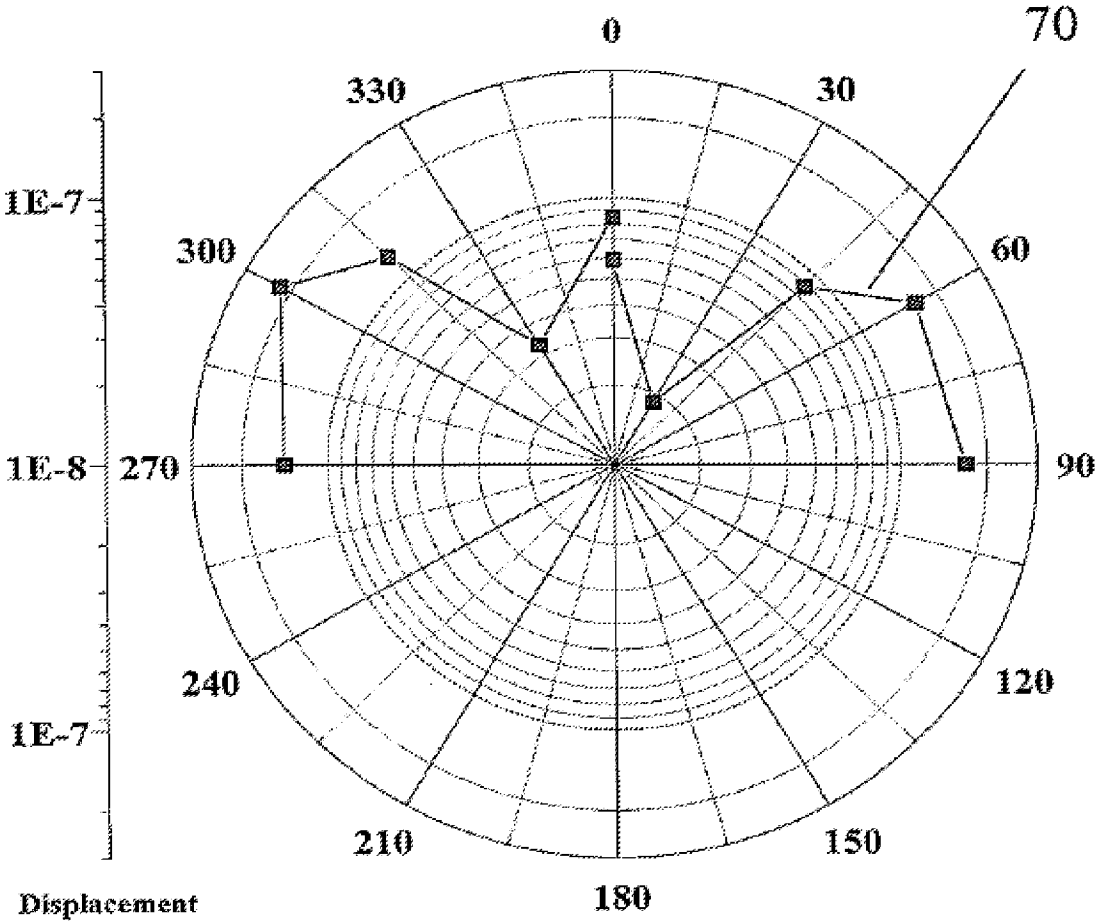
FIG. 7B is a diagram showing experimental results of the sensitivity of a microphone in accordance with an example of the present invention.

FIG. 7B is a diagram showing experimental results of sensitivity of the microphone 7 subject to an incident acoustic wave at the frequency of approximately 8.4 KHz. Referring to FIGS. 7A and 7B, a curve 70 represents displacements of the membrane 12 in response to incident acoustic waves. The microphone 7 may be sensitive to the acoustic waves from a first angle ranging from approximately zero to 90 degrees and a second angle ranging from approximately 270 to 360 degrees.

Figure 8:
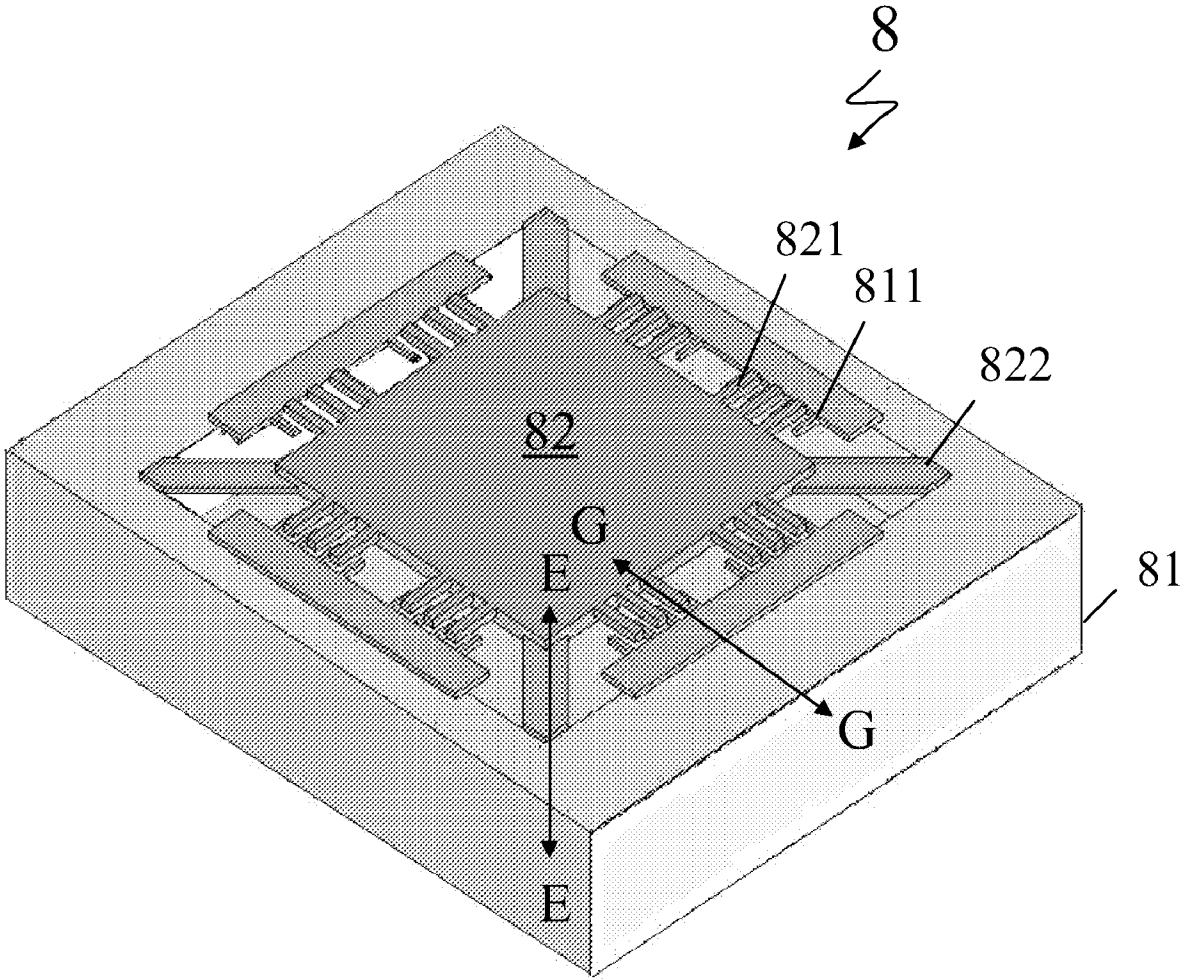
FIG. 8 is a perspective view of an acoustic transducer in accordance with another example of the present invention.

FIG. 8 is a perspective view of an acoustic transducer 8 in accordance with another example of the present invention. Referring to FIG. 8, the acoustic transducer 8 may include a substrate 81 and a membrane 82. The substrate 81 may include a number of projections 811. The membrane 82 may include a number of supports 822 and a number of projections 821. In the present example, the membrane 82 includes four supports 822. One of the supports 822 may extend in a direction "EE", which is transverse to a direction "GG" where the projections 811 and 821 may extend. The structures of the substrate 81, membrane 82, projections 811, 821 and supports 822 may be similar to those of the substrate 11, membrane 12, projections 131, 121 and supports 122 described and illustrated with reference to FIG. 1.

Figure 9:
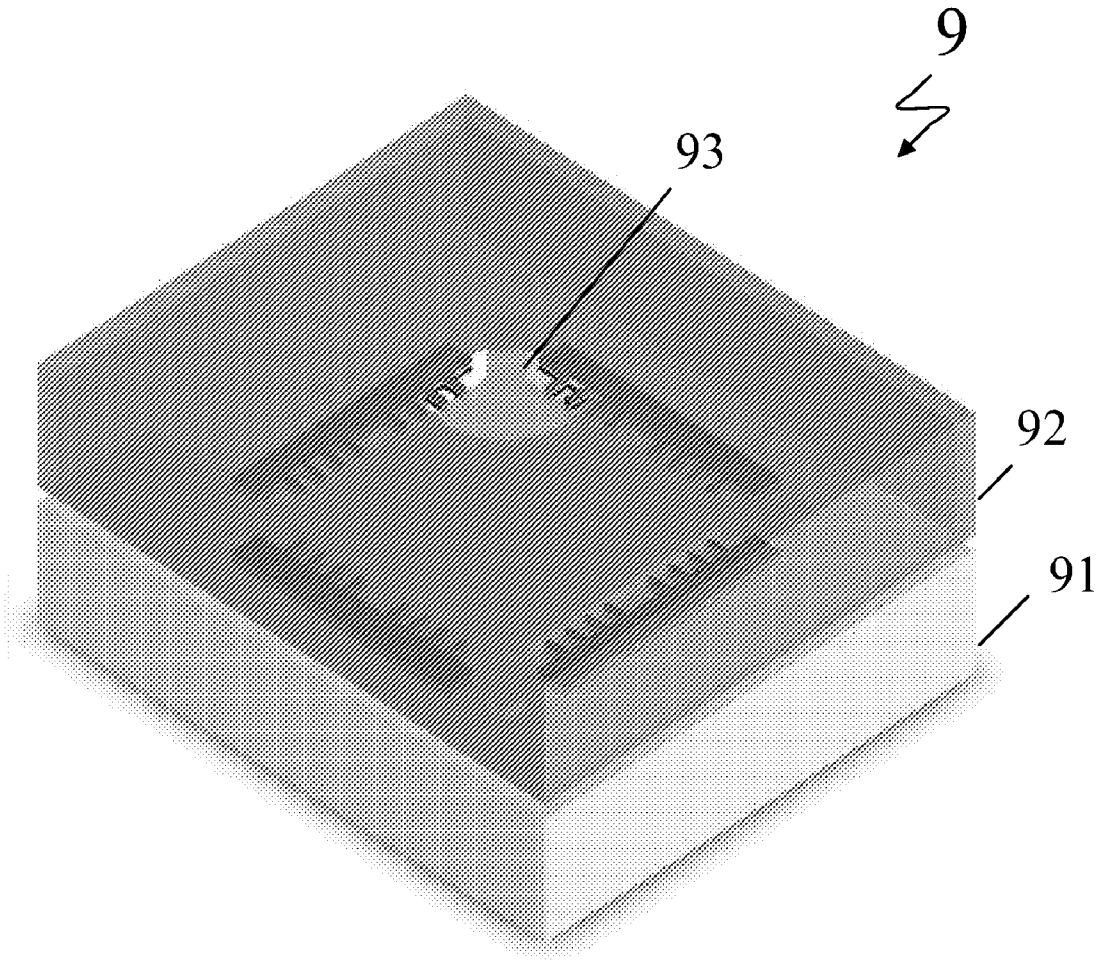
FIG. 9 is a perspective view of a microphone in accordance with another example of the present invention.

FIG. 9 is a perspective view of a microphone 9 in accordance with another example of the present invention. Referring to FIG. 9, the microphone 9 may include an acoustic transducer 91 and a housing 92 covering the acoustic transducer 91. The acoustic transducer 91 may be similar to one of the acoustic transducers 1, 5, 5' and 6 described and illustrated with reference to FIGS. 1, 5A, 5B and 6, respectively. At least one inlet 93 may be formed on a top surface of the housing 92 for conducting acoustic waves into the microphone 9. In the present example, one inlet 93 may be formed on the top surface of the housing 92. An incident acoustic wave from a direction at an angle ranging from approximately zero to 360 degrees with respect to the top surface may pass through the inlet 93 and then impinge on the membrane 82. The microphone 9 may accordingly function to serve as an omni-directional microphone.

It will be appreciated by those skilled in the art that changes could be made to the preferred embodiments described above without departing from the broad inventive concept thereof. It is understood, therefore, that this invention is not limited to the particular embodiments disclosed, but is intended to cover modifications within the spirit and scope of the present application as defined by the appended claims.

We claim:

1. An acoustic transducer comprising:
a substrate;
a membrane configured to move relative to the substrate;
a plurality of supports configured to allow the membrane to vibrate relative to the substrate, at least one of the supports extending in a first direction;
a first group of projections extending from the membrane in a second direction, the second direction and the first direction being transverse to one another; and
a second group of projections extending from the substrate in the second direction, the second group of projections being interweaved with and movable relative to the first group of projections.

2. The acoustic transducer of claim 1, wherein each of the first group of projections is composed of a first conductive layer, a second conductive layer, and a dielectric layer between the first conductive layer and the second conductive layer, and each of the second group of projections is composed of a third conductive layer.

3. The acoustic transducer of claim 1, wherein each of the second group of projections is composed of a first conductive layer, a second conductive layer, and a dielectric layer between the first conductive layer and the second conductive layer, and each of the first group of projections is composed of a third conductive layer.

4. The acoustic transducer of claim 1, wherein the membrane includes a conductive plane and the first group of projections and the supports are arranged on a surface of the conductive plane, the surface facing away from the substrate.

5. The acoustic transducer of claim 1, wherein the membrane includes a conductive plane and the first group of projections and the supports are arranged on a surface of the conductive plane, the surface facing toward the substrate.

6. An acoustic transducer comprising:
a substrate;
a membrane configured to be movable relative to the substrate, the membrane including a conductive plane;

a plurality of supports on the conductive plane, the supports being configured to allow the membrane to pivot relative to the substrate;

a plurality of first projections on the conductive plane of the membrane, each of the first projections including a plurality of conductive layers separated from each other by at least one dielectric layer; and a plurality of second projections over the substrate, the second projections being interweaved with and movable relative to the plurality of first projections, each of the second projections including a plurality of conductive layers separated from each other by at least one dielectric layer.

7. The acoustic transducer of claim 6, wherein the first projections are arranged on a surface of the conductive plane, the surface facing away from the substrate.

8. The acoustic transducer of claim 7 further comprising a first conductive layer between the substrate and the second projections, wherein a variable capacitor is defined between the first conductive layer and the conductive plane.

9. The acoustic transducer of claim 6, wherein the first projections are arranged on a surface of the conductive plane, the surface facing toward the substrate.

10. The acoustic transducer of claim 6 further comprising a housing covering the substrate and the membrane, the housing having at least one opening to expose the membrane.

11. An acoustic transducer comprising:

a substrate;

a membrane configured to move relative to the substrate;

a plurality of supports configured to suspend the membrane over the substrate;

a first group of projections extending from the membrane; and a second group of projections extending from the substrate, the second group of projections being interweaved with and movable relative to the first group of projections, wherein each projection of a first subgroup of the first and second groups of projections is composed of a first conductive layer, a second conductive layer, and a dielectric layer between the first conductive layer and the second conductive layer, and each projection of a second subgroup of the first and second groups of projections is composed of a third conductive layer.

12. The acoustic transducer of claim 11, wherein a first variable capacitor is defined between the first conductive layer and the third conductive layer, and a second variable capacitor is defined between the second conductive layer and the third conductive layer.

13. The acoustic transducer of claim 11, wherein the supports extend in a first direction and the first group of projections extend in a second direction, the first direction being orthogonal to the second direction.

14. The acoustic transducer of claim 11, wherein at least one of the supports extends in a first direction and the first group of projections extend in a second direction, the first direction being transverse to the second direction.

15. The acoustic transducer of claim 11, wherein the membrane includes a conductive plane, and the supports and the first group of projections are arranged on a surface of the conductive plane, the surface facing away from the substrate.

16. The acoustic transducer of claim 15 further comprising a conductive layer between the substrate and the second group of projections, wherein a third capacitor is defined between the conductive layer and the conductive plane.

17. The acoustic transducer of claim 11, wherein the membrane includes a conductive plane, and the supports and the first group of projections are arranged on a surface of the conductive plane, the surface facing toward the substrate.

18. The acoustic transducer of claim 11, wherein the membrane includes a plurality of ribs.

19. The acoustic transducer of claim 11 further comprising a housing covering the substrate and the membrane.

20. The acoustic transducer of claim 19, wherein the housing includes at least one opening.

* * * * *